US006069910A

United States Patent [19]

Eckert

[11] Patent Number: 6,069,910

[45] **Date of Patent: *May 30, 2000**

[54] HIGH EFFICIENCY SYSTEM FOR MELTING MOLTEN ALUMINUM

[76] Inventor: C. Edward Eckert, 26 Lynn Ann Dr., New Kensington, Pa. 15068

[ * ] Notice: This patent is subject to a terminal disclaimer.

[21] Appl. No.: 09/326,518

[22] Filed: Jun. 4, 1999

Related U.S. Application Data

[63] Continuation of application No. 08/995,191, Dec. 22, 1997, Pat. No. 5,963,580.

[51] Int. Cl.[7] ..... H04B 3/60

[52] U.S. Cl. ..... 373/42; 266/217

[58] Field of Search ..... 266/217, 200, 266/242; 126/360; 373/42, 111, 117, 134; 219/420, 421, 426, 523, 534, 535, 544; 392/503, 497; 532/262, 156

[56] References Cited

U.S. PATENT DOCUMENTS 3,793,015 2/1974 Vietz ..... 126/360
5,120,027 6/1992 Pelton ..... 266/200
5,494,265 2/1996 Ventre ..... 266/217

FOREIGN PATENT DOCUMENTS

0726693A1 8/1996 European Pat. Off. .

*Primary Examiner*—Teresa Walberg
*Assistant Examiner*—Quang Van
*Attorney, Agent, or Firm*—Andrew Alexander

[57] ABSTRACT

A method and system of heating a body of molten aluminum, for example, contained in a heating bay, the method comprising providing a body of molten aluminum; projecting an electric powered heater into the body of molten aluminum; passing electric current through the element and adding heat to the body of molten aluminum. The heater is comprised of a sleeve suitable for immersing in the molten aluminum. The sleeve may have a closed end and is comprised of a composite material comprised of an inner layer of titanium or titanium alloy having an outside surface having a refractory coating thereon exposed to the molten aluminum, the refractory coating resistant to attack by the molten aluminum. An electric heating element is located in the sleeve in heat transfer relationship therewith for adding heat to the molten aluminum.

35 Claims, 3 Drawing Sheets

HIGH EFFICIENCY SYSTEM FOR MELTING MOLTEN ALUMINUM

CROSS REFERENCE TO RELATED APPLICATIONS

This application is a Continuation of U.S. Ser. No. 08/995,191, filed Dec. 22, 1997, now U.S. Pat. No. 5,963,580, issued Oct. 5, 1999.

BACKGROUND OF THE INVENTION

This invention relates to aluminum and more particularly, it relates to heating and melting aluminum with very high efficiency and with remarkably low melt loss or skim generation.

Aluminum is melted either continuously, that is, continuous recirculation or in static furnaces using natural gas. In natural gas fired reverberatory continuous melting furnaces, aluminum is recirculated using a molten metal pump, from the furnace, through a side bay or aluminum charging bay to a molten metal treatment bay and then back to the furnace. Aluminum metal to be melted is submerged in the charging bay. The skim or dross and other impurities resulting from the melting are removed in the melt treatment bay. Heat usually generated using natural gas is applied in the furnace.

In static furnaces, aluminum metal is charged directly to the furnace or through an open charge bay. Metal treatment may be provided using a side bay.

This method melting has the problem that it is very inefficient. That is, these furnaces operate at a 22–30% thermal efficiency because heat transfer to the melt in the furnace is effected by radiation from overhead natural gas burners to the melt. In this method of heating, large quantities of heated gases are lost as they are exhausted up the stack, creating environmental problems. This method of heating has the disadvantage that the surface temperature of the melt increases dramatically, resulting in significant skim generation and in melt loss due to oxidation of the molten aluminum. The problem is aggravated as a layer of aluminum oxide or skim forms on the surface of the melt. That is, the layer of aluminum oxide formed on the surface operates as a thermal barrier or insulator to the natural gas fire flames impinging on the surface. Aluminum oxide has a characteristically low thermal conductivity and therefore greatly inhibits heat transfer to the molten aluminum. Thus, not only is this method of heating thermal inefficient, as noted, but this method results in very high levels of melt loss due to the high surface temperature and conversion of aluminum to aluminum oxide. That is, melt loss is a significant problem encountered in this method of heating, generally averaging 2 to 5%. The high levels of skim generated in melting requires intensive molten metal treatment downstream to remove entrained skim particles.

As an alternative to reverberatory furnaces, induction melting, which can be either channel or coreless, has been used. However, coreless induction furnaces only have a thermal efficiency of about 60 to 70%, have to use a water cooled inductor surrounding the crucible and have to use a complex power supply to maintain a power factor of near unity for efficiency purposes. The power supplies are large, involve a reactor and capacitor and also must use water cooling.

Induction heating also has the problem that it stirs or agitates the melt. This constantly exposes new surface air which oxidizes the metal to form aluminum oxide. The oxides along with other impurities are mixed into the melting, resulting in serious metal quality problems. This requires intensive metal treatment with gases and/or salts downstream. This results in environmental problems from disposing of the salts. Also, it adds greatly to the expense of producing high quality metal.

Thus, it will be seen that there is a great need in the aluminum industry for a highly efficient melting system where a large portion of the heat applied is not wasted and which greatly minimizes skim or dross generation and its attendant problems of removing and treating in an environmentally responsible manner.

The present invention provides such a heating and melting system.

SUMMARY OF THE INVENTION

It is an object of this invention to provide an improved method and system for heating and/or melting aluminum.

It is a further object of this invention to provide a highly efficient system for heating and/or melting aluminum.

It is yet a further object of this invention to provide a system for heating and/or melting aluminum having greatly reduced skim or dross generation.

Yet, it is a further object of this invention to provide a recirculating system for heating and/or melting aluminum wherein the heat utilization is near 100% because of less containment losses.

And still it is a further object of this invention to provide a system for heating and melting aluminum having significantly reduced melt loss, e.g., less than 4% and typically less than 2%, resulting from oxidation of the melt.

Still yet, it is another object of this invention to provide a substantially closed system having minimal access to air to thereby minimize oxidation of molten aluminum.

And still yet, it is another object of this invention to provide a portable heat generating means such as a turbo alternator for electric power generation and utilization of exhaust heat to heat or condition solid charge to be melted.

These and other objects will become apparent from a reading of the specification and claims appended hereto.

In accordance with these objects, there is provided a method and system of heating a body of molten aluminum, for example, contained in a heating bay, the method comprising providing a body of molten aluminum; projecting an electric powered heater into the body of molten aluminum; passing electric current through the element and adding heat to the body of molten aluminum. The heater is comprised of a sleeve suitable for immersing in the molten aluminum. The sleeve may have a closed end and is comprised of a composite material comprised of an inner layer of metal such as titanium or titanium alloy having an outside surface having a refractory coating thereon exposed to the molten aluminum, the refractory coating resistant to attack by the molten aluminum. An electric heating element is located in the sleeve in heat transfer relationship therewith for adding heat to the molten aluminum.

DETAILED DESCRIPTION OF THE PREFERRED EMBODIMENTS

Figure 1:
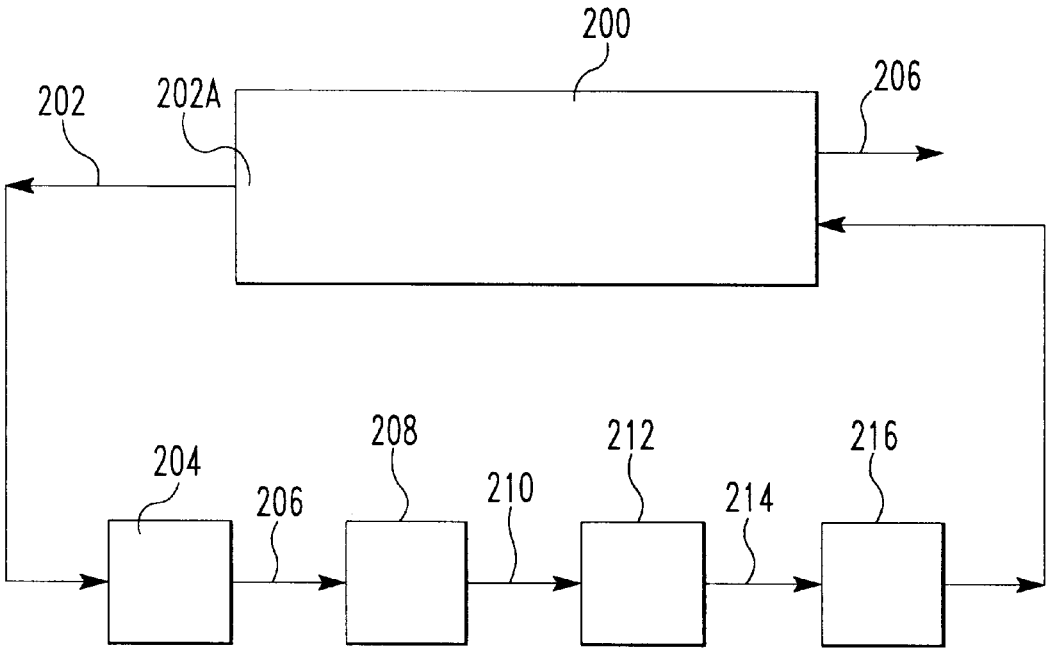
FIG. 1 is a schematic of a system for heating and/or melting aluminum in accordance with the invention.

Referring to FIG. 1, there is shown a schematic of a recirculating system for heating and/or melting metal such as aluminum. In the system, a molten aluminum reservoir 200 is provided and molten aluminum is recirculated along line 202 to a pumping bay 204 which operates to pump molten metal from reservoir 200 and through subsequent steps. Molten aluminum is removed from reservoir 200 along line 206 for casting, for example. Any type of molten aluminum pump may be used which efficiently recirculates molten aluminum through the subsequent treatment stages. Such pumps or impellers are disclosed in U.S. Pat. Nos. 3,997,336 and 4,128,415, for example, incorporated herein by reference.

After the pumping stage, the molten aluminum is removed or conveyed along line 206 to heating bay or stage 208. In bay 208, heat is added for purposes of melting solid aluminum charged in a subsequent bay. Typically, the melt is heated to a temperature in the range of about 1200° to 1500° F. in heat bay 208. Heating bay 208 is accomplished by either electric powered immersion heaters or by electric powered radiation heaters (described hereinafter) mounted close to the surface of the molten metal, e.g., ½ to 18 inches from the surface of the molten aluminum. When radiation heat is used, it is preferred that heating bay 208 is covered with an insulating cover to capture radiant heat and direct it towards the melt.

After heating, molten aluminum is then directed along line 210 to a charging bay 212 where aluminum metal is added for purposes of melting. It should be understood that pumping and melting may be performed in the same bay. For purposes of melting the solid aluminum, the charge may be forcibly submerged along with fluxing salts by any suitable means to accelerate the melting process, such as disclosed in U.S. Pat. Nos. 3,997,336; 4,128,415 and 4,286,985, incorporated herein by reference. After ingesting the solid aluminum, the melt is conveyed along line 214 to metal treatment bay 216 wherein the metal can be treated for purposes of removing impurities such as dissolved gases, e.g., hydrogen, fluxing salts, and undissolved solid particles such as metal oxides. The metal treatment in bay 216 can comprise treatment with a fluxing gas to remove the impurities to the surface of the melt to form a skim layer which can be removed. Fluxing may be achieved by any fluxing means, for example, using a uni-directional impeller but is preferably carried out by the process and apparatus using a bi-directional impeller disclosed in U.S. Pat. Nos. 5,364,450; 5,462,580; 5,462,581; 5,616,167; and 5,630,863, incorporated herein by reference as if specifically set forth.

After the melt has been treated in metal treatment bay 216, it is recirculated back into molten metal reservoir 200 from where the molten metal is withdrawn along line 206, as needed.

The theoretical amount of heat required to be added in heating bay 208 and the cost thereof can be calculated as follows:

$$\dot{Q} = W_{Al}\left(\int_{T_1}^{T_2} Cp\, dT + H_m\right)$$

$\dot{Q}$=heat addition rate, BTU/hr $W_{Al}$=charge rage of aluminum, lb/hr

Cp=heat capacity of aluminum alloy $T_1$–$T_2$=metal entry and exit temperatures dT dT=temperature $H_m$=heat of melting example:

$W_{Al}$=20,000 lb/hr (rate of solid aluminum)

$T_1$=temperature of solid charge aluminum, 100° F.

$T_2$=melt temperature, 1350° F.

$\dot{Q}$=20,000 [0.225 (1350−100)+168]=8.99×10$^6$ BTU/hr (heating rate)

This is the next heat inputrate required for conditions as specified.

Using natural gas heat at 26% thermal efficiency:

natural gas flow rate =

$$8.99\times10^6\frac{\text{BTU}}{\text{hr}}\times\frac{1\ MCF}{1{,}050{,}000\ \text{BTU}}\times\frac{1}{0.26} = 32.93\ MCF\ \text{natural gas}$$

At a typical commercial price for natural gas of $4.50/MCF, the cost to melt aluminum at 20,000 lb/hr is $148.19/hr.

If electric induction melting is used at 63% thermal efficiency:

$KWH =$ $$8.99\times10^6\frac{\text{BTU}}{\text{hr}}\times\frac{1KW-H}{3413\ \text{BTU}}\times\frac{1}{0.63} = 4181\ KW-H\ \text{electrical energy}$$

At a typical commercial price for electricity of $0.015/KW-H, the cost is $62.72/hr.

For melting in accordance with the invention, the cost is:

$$\$62.77\times\frac{0.63}{0.95} = \$41.63/\text{hr.}$$

This is exclusive of melt loss.

For a typical ingot plant using solid charge with a monthly throughput of 100 million lb/month, the savings using the process of the invention are about $2 million/month, taking melt loss into consideration. For some companies, this can be a savings of $100 million per year.

While the process or system is shown utilizing heating bay 208, it should be understood that bay 208 is used for illustration purposes. That is, heat can be applied in line or channel 202 or in line or channel 206 utilizing the heating means of the present invention. Further, heat may be applied to the melt just prior to it being withdrawn from reservoir 200 at 202A. It will be appreciated that heat can be applied anywhere in reservoir 200; however, by applying heat at location 202A, hotter molten metal can be recirculated. Or, heat can be applied at several locations when the heat is supplied in accordance with the present invention.

The present invention has the advantage that it greatly reduces melt loss. Melt loss is the amount of molten aluminum that is lost in the heating and/or melting process to the formation of aluminum oxide and the metallic aluminum that becomes entrained therein. This combination is often referred to as skim or dross and may have other materials such as fluxing salts entrained or entrapped therein. The skim or dross requires intensive processing to recover free metallic aluminum therefrom and presents an environmental disposal problem because of the salt content. The amount of aluminum lost to skim is quite large and is only one of the considerable detriments of the conventional melting and heating systems. Melt loss due to conventional heating and/or melting can be as high as 5%. Thus, for every million pounds of aluminum heated or melted, 50,000 pounds are lost to skim or dross. The direct cost in terms of melt loss is extremely high. Indirect costs are incurred in terms of skim treatments for environmental reasons and recovery of entrained metal. However, the cost in terms of inefficient heating, for example, 25% efficiency, is also extremely high because the inefficient heating applies to the total pounds of aluminum heated or melted. Because of inefficient heating, the size of furnaces utilized is very large, often being five times larger than required, also adding greatly to construction costs and heating costs to maintain temperature in such conventional furnaces.

The heating system in accordance with the present invention employs high watt density immersion heaters capable of watt densities of 25 to 375 watts/in$^2$ of heater surface for applying heat to the melt beneath the surface of the melt where substantially all the heat generated is applied to the melt with only minimal heat losses. That is, compared to conventional heating of 25% efficiency, the present invention results in a heating efficiency of greater than 90% and typically greater than 95% efficiency, with only minimal melt loss, typically 1 to 2%, depending to some extent on the heating and/or melting operation and cleanliness of the solid metal being melted.

Figure 2:
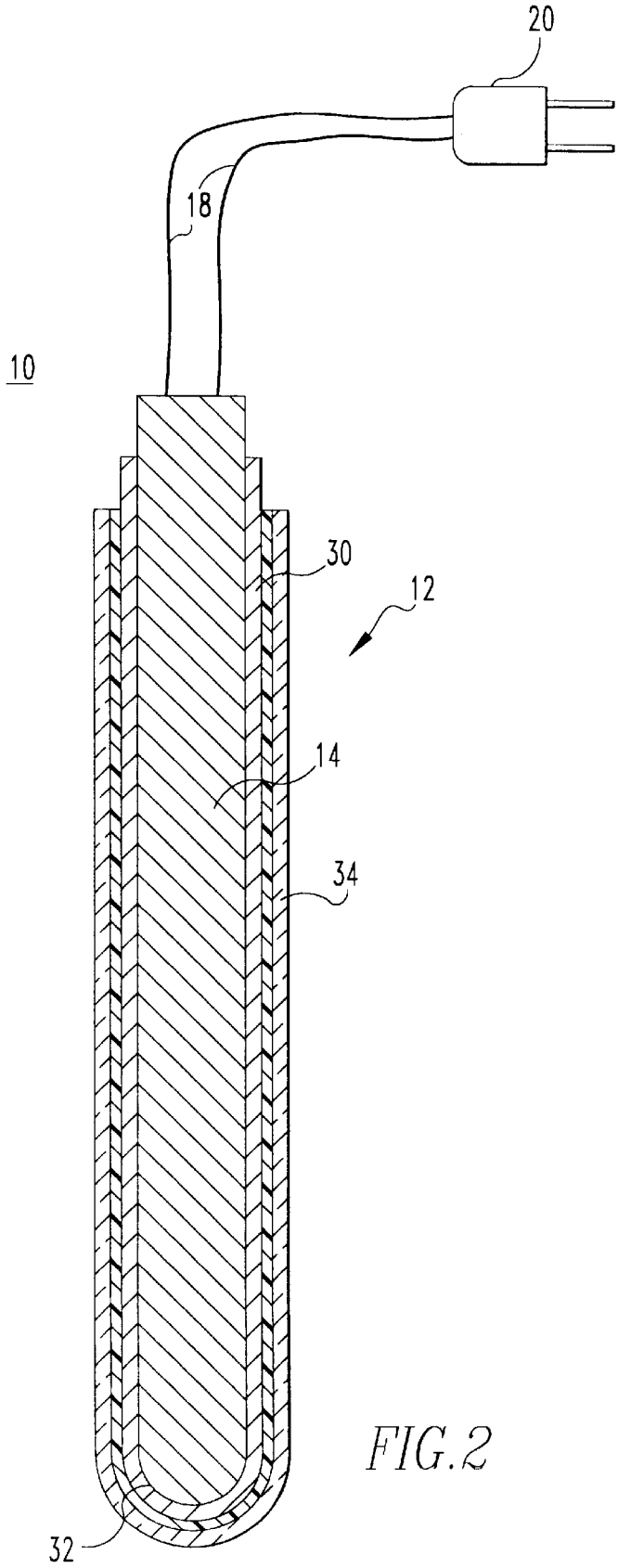
FIG. 2 is a schematic of an electric heater for use in a heating bay or channel, for example, for supplying heat for heating and/or melting aluminum in accordance with the invention.

Referring to FIG. 2, there is shown a schematic of an electric heater assembly 10 for use in the heating and/or melting system of the invention. The electric heater assembly is comprised of a protective sleeve 12 and an electric heating element 14. A lead 18 extends from electric heating element 14 and terminates in a plug 20 suitable for plugging into a power source. A suitable element 14 is available from International Heat Exchange, Inc., Yorba Linda, Calif. 92687 under the designation Maxi-Zone, or Ogden Manufacturing Co., Arlington Heights, Ill. 60005.

Preferably, protective sleeve 12 is comprised of titanium tube 30 having an end 32 which preferably is closed. While the protective sleeve is illustrated as a tube, it will be appreciated that any configuration that protects or envelops electric heating element 14 may be employed. Thus, reference to tube or sleeve herein is meant to include such configurations. A refractory coating 34 is employed which is resistant to attack by the environment in which the electric heater assembly is used. A bond coating may be employed between the refractory coating 34 and titanium tube 30. Electric heating element 14 is seated or secured in tube 30 by any convenient means. For example, swaglock nuts and ferrules may be employed or the end of the tube may be crimped or swaged shut to provide a secure fit between the electric heating element and tube 30. Alternatively, welding can be used. In the invention, any of these methods of holding the electric heating element in tube 30 may be employed. It should be understood that tube 30 does not always have to be sealed. In one embodiment, electric heating element 14 is encapsulated in a metal tube 15, e.g., steel or Inconel tube, which is then inserted into tube 30 to provide an interference or friction fit. The present invention contemplates and prefers a heating element 14 without a metal tube 15. It is preferred that electric heating element 14, when it utilizes a metal tube 15, has the outside surface of tube 15 in contact with the inside surface of tube 30 to promote heat transfer through tube 30 into the molten metal. Thus, air gaps between the surface of metal tube 15 of electric heating element 14 and inside surface of tube 30 should be minimized.

If electric heating element 14 is inserted in tube 30 with a friction fit, the fit gets tighter with heat because electric heating element 14 expands more than tube 30, particularly when tube 30 is formed from titanium.

While it is preferred to fabricate tube 30 out of a titanium base alloy, tube 10 may be fabricated from any metal or metalloid material suitable for contacting molten metal and which material is resistant to dissolution or has controlled dissolution or erosion by the molten metal. Other materials that may be used to fabricate tube 30 include niobium, chromium, molybdenum, combinations of NiFe (364 NiFe) and NiTiC (40 Ni 60 TiC), particularly when such materials have low thermal expansion, all referred to herein as metals. Other metals suitable for tube 30 include: 400 series stainless steel including 410, 416 and 422 stainless steel; Greek ascoloy; precipitation hardness stainless steels, e.g., 15-7 PH, 174-PH and AM350; Inconel; nickel based alloys, e.g., Unitemp 1753; Kovar, Invar, Super Nivar, Elinvar, Fernico, Fernichrome; metal having composition 30–68 wt. % Ni, 0.02–0.2 wt. % Si, 0.01–0.4 wt. % Mn, 48–60 wt. % Co, 9–10 wt. % Cr, the balance Fe. For protection purposes, it is preferred that the metal or metalloid be coated with a material such as a refractory resistant to attack by molten metal and suitable for use as a protective sleeve. Alternatively, cast iron tubes may be employed, for example, for molten aluminum without a protective refractory coating. However, cast iron tubes have a dissolution rate in molten aluminum in the range of 0.0033 to 0.167 in$^2$ of area loss/in$^2$ of original area/hr.

Further, the material or metal of construction for tube 30 may have a thermal conductivity of less than 30 BTU/ft hr ° F., and less than 15 BTU/ft hr ° F., with material having a thermal conductivity of less than 10 BTU/ft hr ° F. being useful. Another important feature of a desirable material for tube 30 is thermal expansion. Thus, a suitable material should have a thermal expansion coefficient of less than $15\times10^{-6}$ in/in/° F., with a preferred thermal expansion coefficient being less than $10\times10^{-6}$ in/in/° F., and the most preferred being less than $7.5\times10^{-6}$ in/in/° F. and typically less than $5\times10^{-6}$ in/in/° F. The material or metal useful in the present invention can have a controlled chilling power. Chilling power is defined as the product of heat capacity, thermal conductivity and density. Thus, the metal in accordance with the invention may have a chilling power of less than 5000 BTU$^2$/ft$^4$ hr ° F., preferably less than 2000 BTU$^2$/ft$^4$ hr ° F., and typically in the range of 100 to 750 BTU$^2$/ft$^4$ hr ° F.

As noted, the preferred material for fabricating into tubes 30 is a titanium base material or alloy having a thermal conductivity of less than 30 BTU/ft hr ° F., preferably less than 15 BTU/ft hr ° F., and typically less than 10 BTU/ft hr ° F., and having a thermal expansion coefficient less than $15\times10^{-6}$ in/in/° F., preferably less than $10\times10^{-6}$ in/in/° F., and typically less than $5\times10^{-6}$ in/in/° F. The titanium material or alloy should have a chilling power as noted, and for titanium, the chilling power can be less than 500, and preferably less than 400, and typically in the range of 100 to 300 BTU/ft$^2$ hr ° F.

When the electric heater assembly is being used in molten metal such as lead, for example, the titanium base alloy need not be coated to protect it from dissolution. For other metals, such as aluminum, copper, steel, zinc and magnesium, refractory-type coatings should be provided to protect against dissolution of the metal or metalloid tube by the molten metal. By the use of titanium herein in meant to include titanium and titanium alloys.

For most molten metals, the titanium alloy that should be used is one that preferably meets the thermal conductivity requirements, the chilling power and, more importantly, the thermal expansion coefficient noted herein. Further, typically, the titanium alloy should have a yield strength of 30 ksi or greater at room temperature, preferably 70 ksi, and typical 100 ksi. The titanium alloys included herein and useful in the present invention include CP (commercial purity) grade titanium, or alpha and beta titanium alloys or near alpha titanium alloys, or alpha-beta titanium alloys. The alpha or near-alpha alloys can comprise, by wt. %, 2 to 9 Al, 0 to 12 Sn, 0 to 4 Mo, 0 to 6 Zr, 0 to 2 V and 0 to 2 Ta, and 2.5 max. each of Ni, Nb and Si, the remainder titanium and incidental elements and impurities.

Specific alpha and near-alpha titanium alloys contain, by wt. %, about:

(a) 5 Al, 2.5 Sn, the remainder Ti and impurities.

(b) 8 Al, 1 Mo, 1 V, the remainder Ti and impurities.

(c) 6 Al, 2 Sn, 4 Zr, 2 Mo, the remainder Ti and impurities.

(d) 6 Al, 2 Nb, 1 Ta, 0.8 Mo, the remainder Ti and impurities.

(e) 2.25 Al, 11 Sn, 5 Zr, 1 Mo, the remainder Ti and impurities.

(f) 5 Al, 5 Sn, 2 Zr, 2 Mo, the remainder Ti and impurities.

The alpha-beta titanium alloys comprise, by wt. %, 2 to 10 Al, 0 to 5 Mo, 0 to 5 Sn, 0 to 5 Zr, 0 to 11 V, 0 to 5 Cr, 0 to 3 Fe, with 1 Cu max., 9 Mn max., 1 Si max., the remainder titanium, incidental elements and impurities.

Specific alpha-beta alloys contain, by wt. %, about:

(a) 6 Al, 4 V, the remainder Ti and impurities.

(b) 6 Al, 6 V, 2 Sn, the remainder Ti and impurities.

(c) 8 Mn, the remainder Ti and impurities.

(d) 7 Al, 4 Mo, the remainder Ti and impurities.

(e) 6 Al, 2 Sn, 4 Zr, 6 Mo, the remainder Ti and impurities.

(f) 5 Al, 2 Sn, 2 Zr, 4 Mo, 4 Cr, the remainder Ti and impurities.

(g) 6 Al, 2 Sn, 2 Zn, 2 Mo, 2 Cr, the remainder Ti and impurities.

(h) 10 V, 2 Fe, 3 Al, the remainder Ti and impurities.

(i) 3 Al, 2.5 V, the remainder Ti and impurities.

The beta titanium alloys comprise, by wt. %, 0 to 14 V, 0 to 12 Cr, 0 to 4 Al, 0 to 12 Mo, 0 to 6 Zr and 0 to 3 Fe, the remainder titanium and impurities.

Specific beta titanium alloys contain, by wt. %, about:

(a) 13 V, 11 Cr, 3 Al, the remainder Ti and impurities.

(b) 8 Mo, 8 V, 2 Fe, 3 Al, the remainder Ti and impurities.

(c) 3 Al, 8 V, 6 Cr, 4 Mo, 4 Zr, the remainder Ti and impurities.

(d) 11.5 Mo, 6 Zr, 4.5 Sn, the remainder Ti and impurities.

When it is necessary to provide a coating to protect tube 30 of metal or metalloid from dissolution or attack by molten metal, a refractory coating 34 is applied to the outside surface of tube 30. The coating should be applied above the level to which the electric heater assembly is immersed in the molten metal. The refractory coating can be any refractory material which provides the tube with a molten metal resistant coating The refractory coating can vary, depending on the molten metal. Thus, a novel composite material is provided permitting use of metals or metalloids having the required thermal conductivity and thermal expansion for use with molten metal which heretofore was not deemed possible.

Because titanium or titanium alloy readily forms titanium oxide, it is important in the present invention to avoid or minimize the formation of titanium oxide on the surface of titanium tube 30 to be coated with a refractory layer. That is, if oxygen permeates the refractory coating, it can form titanium oxide and eventually cause spalling of the refractory coating and failure of the heater. To minimize or prevent oxygen reacting with the titanium, a layer of titanium nitride is formed on the titanium surface. The titanium nitride is substantially impermeable to oxygen and can be less than about 1 $\mu$m thick. The titanium nitride layer can be formed by reacting the titanium surface with a source of nitrogen, such as ammonia, to provide the titanium nitride layer.

When the electric heater assembly is to be used for heating molten metal such as aluminum, magnesium, zinc, or copper, etc., a refractory coating may comprise at least one of alumina, zirconia, yittria stabilized zirconia, magnesia, magnesium titanite, or mullite or a combination of alumina and titania. While the refractory coating can be used on the metal or metalloid comprising the tube, a bond coating can be applied between the base metal and the refractory coating. The bond coating can provide for adjustments between the thermal expansion coefficient of the base metal alloy, e.g., titanium, and the refractory coating when necessary. The bond coating thus aids in minimizing cracking or spalling of the refractory coat when the tube is immersed in the molten metal or brought to operating temperature. When the electric heater assembly is cycled between molten metal temperature and room temperature, for example, the bond coat can be advantageous in preventing cracking, particularly if there is a considerable difference between the thermal expansion of the metal or metalloid and the refractory.

Typical bond coatings comprise Cr—Ni—Al alloys and Cr—Ni alloys, with or without precious metals. Bond coatings suitable in the present invention are available from Metco Inc., Cleveland, Ohio, under the designation 460 and 1465. In the present invention, the refractory coating should have a thermal expansion that is plus or minus five times that of the base material. Thus, the ratio of the coefficient of expansion of the base material can range from 5:1 to 1:5, preferably 1:3 to 1:1.5. The bond coating aids in compensating for differences between the base material and the refractory coating.

The bond coating has a thickness of 0.1 to 5 mils with a typical thickness being about 0.5 mil. The bond coating can be applied by sputtering, plasma or flame spraying, chemical vapor deposition, spraying, dipping or mechanical bonding by rolling, for example.

After the bond coating has been applied, the refractory coating is applied. The refractory coating may be applied by any technique that provides a uniform coating over the bond coating. The refractory coating can be applied by aerosol, sputtering, plasma or flame spraying, for example. Preferably, the refractory coating has a thickness in the range of 0.3 to 42 mils, preferably 5 to 15 mils, with a suitable thickness being about 10 mils. The refractory coating may be used without a bond coating.

In another aspect of the invention, boron nitride may be applied as a thin coating on top of the refractory coating. The boron nitride may be applied as a dry coating, or a dispersion of boron nitride and water may be formed and the dispersion applied as a spray. The boron nitride coating is not normally more than about 2 or 3 mils, and typically it is less than 2 mils.

The heater assembly of the invention can operate at watt densities of 25 to 250 watts/in$^2$ and typically 40 to 175 watts/in$^2$.

The heater assembly for use in the heating and melting system has the advantage of a metallic-composite sheath for strength and improved thermal conductivity. The strength is important because it provides resistance to mechanical abuse and permits an ultimate contact with the internal element. When a metal tube 15 is used, intimate contact between heating element metal tube 15 and sheath I.D. provides for substantial elimination of an annular air gap between heating element and sheath. In prior heaters, the annular air gap resulted in radiation heat transfer and also back radiation to the element from inside the sheath wall which limits maximum heat flux. By contrast, the heater of the invention employs an interference fit that results in essentially only conduction.

In conventional heaters, heating element tube 15 is not in intimate contact with the protection tube resulting in an annular air gas or space therebetween. Thus, the element is operated at a temperature independent of the tube. Heat from the element is not efficiently removed or extracted by the tube, greatly limiting the efficiency of the heaters. Thus, in conventional heaters, the element has to be operated below a certain fixed temperature to avoid overheating the element, greatly limiting the heat flux.

The heater assembly very efficiently extracts heat from the heating element and is capable of operating close to molten metal, e.g., aluminum temperature. The heater assembly is capable of operating at watt densities of 40 to 175 watts/in$^2$. The low coefficient of expansion of the composite sheath, which is lower than heating element tube 15, provides for intimate contact of the heating element with the composite sheath.

Figure 3:
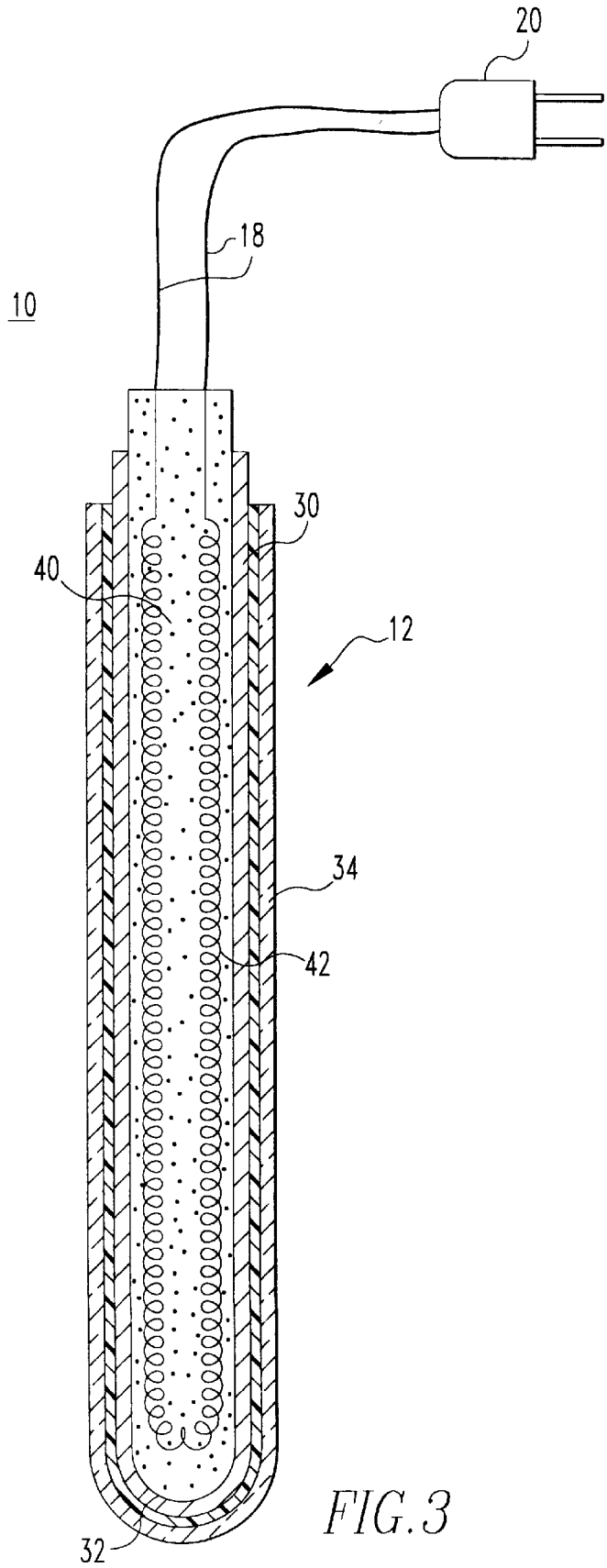
FIG. 3 is a cross-sectional view of an electric heater assembly showing a heating element wire insulated by a contact medium from a protective sleeve.

For better heat conduction from the heating element 42 (FIG. 3) to protective sleeve 12, a contact medium such as a low melting point, low vapor pressure metal alloy may be placed in the heating element receptacle in the baffle. The low melting metal alloy can comprise lead-bismuth eutectic having the characteristic low melting point, low vapor pressure and low oxidation and good heat transfer characteristics. Magnesium or bismuth may also be used. The heater can be protected, if necessary, with a sheath of stainless steel; or a chromium plated surface can be used. After a molten metal contact medium is used, powdered carbon may be applied to the annular gap to minimize oxidation.

Alteratively, a powdered material 40 may be placed in the heating element receptacle. When the contact medium is a powdered material, it can be selected from silica carbide, magnesium oxide, carbon or graphite, for example. When a powdered material is used, the particle size should have a median particle size in the range from about 0.03 mm to about 0.3 mm or equivalent U.S. Standard sieve series. This range of particle size greatly improves the packing density of the powder and hence the heat transfer from electric element wire 42 (FIG. 3) to protective sleeve 12. For example, if mono-size material is used, this results in a one-third void fraction. The range of particle size reduces the void fraction below one-third significantly and improves heat transfer. Also, packing the range of particle size tightly improves heat transfer.

When baffles are used, the shape of the opening, straightness and surface topography present in the baffle also determine the intimacy of fit between the heater and baffle material. Commercial refractory casting techniques do not always assure that the most desirable conditions (i.e., circular cross section, straightness, and smooth interior surface of the holes to provide a close fit diameter) for heat transfer are obtained.

To overcome these limitations, tubes of machined graphite or carbon, or suitable metals, such as titanium, titanium alloys, Kovar, Invar, and Nilo may be used as inserts. Such inserts would be installed in the mold used to cast the baffle prior to introducing the refractory material to be cast. The tubes not only function as cores to form the holes during casting, but to provide improved heat transfer by creating more optimum conditions.

Heating elements that are suitable for use in the present invention are available from Ogden Manufacturing Co., Arlington Heights, Ill. 60005, or International Heat Exchange Inc., Yorba Linda, Calif. 92687. These heating elements are often encased in steel or Inconel tubes and use ICA or nichrome elements.

In another feature of the invention, a thermocouple (not shown) may be inserted between sleeve 12 and heating element 14 or heating element wire 42. The thermocouple may be used for purposes of control of the heating element to ensure against overheating of the element in the event that heat is not transferred away sufficiently fast from the heating assembly. Further, the thermocouple can be used for sensing the temperature of the molten metal. That is, sleeve 12 may extend below or beyond the end of the heating element to provide a space and the sensing tip of the thermocouple can be located in the space.

In the present invention, it is important to use a heater control. That is, for efficiency purposes, it is important to operate heaters at highest watt density while not exceeding the maximum allowable element temperature, as noted earlier. The thermocouple placed in the heater senses the temperature of the heater element. The thermocouple can be connected to a controller such as a cascade logic controller to integrate the heater element temperature into the control loop. Such cascade logic controllers are available from Watlow Controls, Winona, Minn., designated Series 988.

Heating element wire or member 42 of the present invention is preferably comprised of titanium or a titanium alloy. The titanium or titanium alloy useful for heating element member 42 can be selected from the above list of titanium alloys. Titanium or titanium alloy is particularly suitable because of its high melting point which is 3137° F. for high purity titanium. That is, a titanium element can be operated at a higher heater internal temperature compared to conventional elements, e.g., Nichrome which melts at 2650° F. Thus, a titanium based element 42 can provide higher watt densities without melting the element. Further, electrical characteristics for titanium remain more constant at higher temperatures. Titanium or titanium alloy forms a titanium oxide coating or titania layer (a coherent oxide layer) which protects the heating element wire. In a preferred embodiment of the present invention, an oxidant material is added or provided within the sleeve of the heater assembly to provide a source of oxygen for purposes of forming or repairing the coherent titanium oxide layer. The oxidant may be any material that forms or repairs the titanium oxide layer. The source of oxygen can include manganese dioxide or potassium permanganate which may be added with the powdered contact medium.

The oxidant, such as manganese dioxide or potassium permanganate, can be added to conventional heaters employing a powder contact medium to provide a source of oxygen for conventional heating wire such as ICA elements. This permits conventional heating elements to be sealed.

In another aspect of the invention, it has been found that intimate contact or fit can be obtained by swaging metal tube 30 about or onto heating element 14. It will be appreciated that element 14 is circular in cross section and, therefore, tube 30 can be swaged tightly onto element 14, thereby substantially eliminating air gaps. Swaging includes the operation of working and partially reshaping metal tube 30, particularly the inside diameter, placing in compression, the tube contents, and more exactly fitting the outside diameter of element 14 to eliminate air gaps between element 14 and tube 30. It will be appreciated that intermediate tubes may be placed between the heating element of the heater assembly and tube 30. Further, the invention contemplates a preferred heating element wire 42 (FIG. 3) surrounded by an electrical insulating material such as a powder which has good heat conduction, e.g., magnesium oxide, contained by tube 30 only without any intermediate tubes such as steel tubes.

Intimate contact and dense fill of the MgO powder is essential to proper heater operation, one means of providing improved fill density is to form a slurry comprising fluid or liquid vehicle, i.e., water or alcohol, and the dispersoid powder, i.e., MgO. Once a heater tube is filled with the slurry, entrapped air can be removed by vibration and/or vacuum.

A chemical binder may be employed that incorporates a chemical reaction to consume the vehicle, or progressive volitalization can be used to properly evaporate the vehicle. Progressive volitalization is a process that heats the tube from the closed end towards the open end in a progressive manner. Suitable heating means include induction, radiation and microwave/radio frequency. The heating means is moved from the closed to open end of the tube, thus assuring vapor phase vehicle to freely pass through the remaining liquid slurry.

When tube 30 is swaged on heater element 14, the refractory coating is applied after swaging. Whether the heater assembly is made by inserting heating element 14 into tube 30 or by swaging, as noted, it can be beneficial to use a contact medium for better heat conduction between heating element 14 and tube 30. The contact medium can be a powdered material located between the heating element and the tube. The powdered material can be selected from silicon carbide, magnesium oxide and carbon or graphite if the heating element is contained in an intermediate tube. If no intermediate tube is used, the contact medium must provide electrical insulation as well as good heat conduction. The powdered material should have a median particle size ranging from about 0.03 to 0.3 mm. The powdered material has the effect of filling any voids between the heating element and the tube. The range of size for the powdered material improves heat conduction by minimizing void fraction. Swaging is very beneficial with the powdered material because the swaging effectively packs the powder tighter for improved heat conduction.

The inside of tube 30 may be treated to provide a roughening effect or controlled RMS for improved packing of powder against the inside wall of tube 30. That is, having a range of particle size and a roughened inside wall provides a higher level of contact by said powdered contact medium and therefore a greater level of heat conduction to the wall. In addition, providing the element with a roughened surface improves heat conduction to the powdered contact medium. If an intermediate metal tube, e.g., a steel tube, is used, then it is also important to provide it with a roughened surface for heat transfer.

Another contact medium that may be used includes high temperature pastes such as anti-seize compounds having a nickel or copper base.

It will be appreciated that heating and/or melting in accordance with process steps of this invention, greatly reduces melt loss or greatly reduces the amount of skim generated. To further minimize skim, the molten aluminum reservoir can be provided with an inert gas atmosphere (inert to aluminum). Alternatively, the surface of molten aluminum exposed to the atmosphere can be minimized by design of the lid or top of the molten metal reservoir because there is now no need for a large surface area to be contacted with impinging gas fired flames. That is, the molten reservoir can be designed on a volumetric basis rather than a surface area heated by overhead burners.

Efficiency of heating the heating and/or melting system in accordance with the invention can use novel electric power generation means including turbine engines coupled to an electric power generator. Economic fuel sources can be selected for the turbine for power generation and scrap to be melted, e.g., beverage container scrap, can be delaquered and preheated using exhaust gases from the turbine which can have temperatures in the range of 800° to 1000° F. Similarly, oily milling chips can be pretreated with turbine exhaust gases to remove impurities prior to melting. The turbine generator provides a source of power which is portable. That is, because of the high efficiency of this melting system, smaller molten metal reservoirs can be utilized, greatly improving efficiency and economics of the heating and/or melting process.

While the invention has been described in terms of preferred embodiments, the claims appended hereto are intended to encompass other embodiments which fall within the spirit of the invention.

What is claimed is:

1. A method of heating a body of molten aluminum contained in a heating bay, comprising the steps of:

(a) providing a body of molten aluminum;

(b) projecting an electric powered heater into said body of molten aluminum, said heater comprised of:

(i) a sleeve suitable for immersing in said molten aluminum, the sleeve comprised of a metal or a composite material comprised of an inner layer of metal having a coefficient of thermal expansion of less than $10\times10^{-6}$ in/in/° F. and having an outside surface having a refractory coating thereon exposed to said molten aluminum, said refractory coating resistant to attack by said molten aluminum and having a coefficient of thermal expansion of less than $10\times10^{-6}$ in/in/° F.; and (ii) an electric heating element located in said sleeve in heat transfer relationship therewith for adding heat to said molten aluminum, said heater operated at a watt density in the range of 25 to 350 watts/in$^2$; and (c) passing electric current through said element and adding heat to said body of molten aluminum.

2. The method in accordance with claim 1 wherein said inner layer of metal is titanium.

3. The method in accordance with claim 1 including adding heat from said heater to said molten aluminum at a watt density of 50 to 200 watts/in$^2$.

4. The method in accordance with claim 1 including adding heat from said heater to said molten aluminum at a watt density of 75 to 150 watts/in$^2$.

5. The method in accordance with claim 1 including providing a molten aluminum reservoir and circulating molten aluminum from said reservoir through said heating bay and back to said reservoir.

6. The method in accordance with claim 1 including providing a molten aluminum reservoir and circulating molten aluminum from said reservoir through said heating bay and thereafter through a melting bay wherein solid aluminum is ingested and recirculated back to said reservoir.

7. The method in accordance with claim 6 including providing a molten aluminum treatment bay after said melting bay wherein said molten aluminum is treated to remove impurities therefrom.

8. The method in accordance with claim 5 including circulating said molten aluminum using a pump for pumping molten aluminum.

9. The method in accordance with claim 5 including heating said molten aluminum in said heating bay to a temperature in the range of 1025° to 1850° F.

10. The method in accordance with claim 7 including fluxing said molten aluminum in said treatment bay for purposes of removing said impurities.

11. The method in accordance with claim 1 wherein the metal and said refractory coating have each a thermal expansion coefficient of less than $10\times10^{-6}$ in/in/° F.

12. The method in accordance with claim 1 wherein said metal is a titanium base alloy selected from the group consisting of alpha, beta, near alpha, and alpha-beta titanium alloys.

13. The method in accordance with claim 1 wherein said metal is a titanium base alloy selected from the group consisting of 6242, 1100 and CP grade.

14. The method in accordance with claim 1 wherein a bond coating is provided between the outside surface and the refractory coating.

15. The method in accordance with claim 1 wherein the refractory coating is selected from the group consisting of one of $Al_2O_3$, $ZrO_2$, $Y_2O_3$ stabilized $ZrO_2$, and $Al_2O_3$—$TiO_2$.

16. The method in accordance with claim 1 wherein a bond coating is provided between said outside surface and said refractory coating and said bond coating comprises an alloy selected from the group consisting of a Cr—Ni—Al alloy and a Cr'Ni alloy.

17. The method in accordance with claim 1 wherein said metal for said sleeve is comprised of cast iron.

18. A method of adding heat to a body of aluminum contained in a heating bay, comprising the steps of:

(a) providing a body of molten aluminum in a heating bay;

(b) immersing an electric powered heater in said body of molten aluminum, said heater comprised of:

(i) a tube having a closed end suitable for immersing in said molten aluminum, the tube comprised of an inner layer of titanium or titanium alloy having an outside surface having a refractory coating thereon exposed to and resistant to attack from said molten aluminum, said inner layer of titanium or titanium alloy having a coefficient of expansion of less than $10\times10^{-6}$ in/in/° F.;

(ii) the refractory coating is selected from the group consisting of $Al_2O_3$, $ZrO_2$, $Y_2O_3$ stabilized $ZrO_2$, and $Al_2O_3$—$TiO_2$, the refractory coating having a coefficient of expansion of less than $10\times10^{-6}$ in/in/° F.; and (iii) an electric powered heating element located in said tube in heat transfer relationship therewith for adding heat to said molten aluminum; and (d) passing electric current through said element and adding heat to said body of molten aluminum.

19. The method in accordance with claim 18 including a bond layer located between said outside surface and said refractory coating.

20. The method in accordance with claim 18 including adding heat to said body of molten aluminum by operating said heater at a watt density of 20 to 250 watts/in$^2$.

21. The method in accordance with claim 18 including adding heat to said body of molten aluminum by operating said heater at a watt density of 30 to 200 watts/in$^2$.

22. The method in accordance with claim 18 including adding heat to said body of molten aluminum by operating said heater at a watt density of 40 to 150 watts/in$^2$.

23. The method in accordance with claim 18 wherein said refractory coating has a layer of boron nitride thereon.

24. The method in accordance with claim 18 wherein both said inner layer and said refractory layer have coefficients of expansion of less than $5\times10^{-6}$ in/in/° F.

25. A method of adding heat to a body of aluminum contained in a heating bay, comprising the steps of:

(a) providing a body of molten aluminum in a heating bay;

(b) immersing an electric powered heater in said body of molten aluminum, said heater comprised of a tube of cast iron metal having an end suitable for immersing in said molten aluminum;

(c) an electric powered heating element located in said tube in heat transfer relationship therewith for adding heat to said molten aluminum; and (d) passing electric current through said element and adding heat to said body of molten aluminum at a rate of 50 to 250 watts/in$^2$.

26. A recirculating method for heating or melting solid aluminum in molten aluminum, the method including the steps of:

(a) circulating molten aluminum from a reservoir through at least one of a pumping bay, a heating bay, an aluminum metal charging bay and a treatment bay back to said reservoir; and (b) heating said molten aluminum in said heating bay with an electric heater providing heat to said molten aluminum at a watt density of 20 to 350 watts/in$^2$, said heater comprised of a composite material having an inner layer of metal having a coefficient of thermal expansion less than $10\times10^{-6}$ in/in/° F. and having an outer surface having a refractory coating thereon exposed to said molten aluminum and resistant to attack by said molten aluminum, said refractory coating having a coefficient of thermal expansion less than $10\times10^{-6}$ in/in/° F.

27. The method in accordance with claim 26 wherein said inner layer of metal is selected from the group consisting of titanium, non-austenetic stainless steels, "Invar" and "Kovar".

28. The method in accordance with claim 26 wherein said inner layer of metal is a titanium alloy selected from the group consisting of alpha, beta, near alpha, and alpha-beta titanium alloys.

29. The method in accordance with claim 26 wherein said watt density is in the range of 30 to 200 watts/in$^2$.

30. The method in accordance with claim 26 wherein said watt density is in the range of 40 to 150 watts/in$^2$.

31. The method in accordance with claim 26 wherein said inner layer has a coefficient of expansion of less than $5\times10^{-6}$ in/in/° F.

32. The method in accordance with claim 26 wherein said refractory coating has a coefficient of expansion of less than $5\times10^{-6}$ in/in/° F.

33. The electric heater assembly in accordance with claim 26 wherein the refractory coating is selected from the group consisting of one of $Al_2O_3$, $ZrO_2$, $Y_2O_3$ stabilized $ZrO_2$, and $Al_2O_3$—$TiO_2$.

34. The electric heater assembly in accordance with claim 26 wherein a bond coating is provided between said inner layer of metal and said refractory coating and said bond coating comprises an alloy selected from the group consisting of a Cr—Ni—Al alloy and a Cr—Ni alloy.

35. A recirculating method for heating or melting solid aluminum in molten aluminum, the method including the steps of:

(a) circulating molten aluminum from a reservoir through a pumping bay, a heating bay, an aluminum metal charging bay and a treatment bay back to said reservoir; and (b) heating said molten aluminum in said heating bay with an electric heater providing heat to said molten aluminum at a watt density of 30 to 200 watts/in$^2$, said heater comprised of a composite material having an inner layer of metal of titanium or titanium alloy having a coefficient of thermal expansion less than $5\times10^{-6}$ in/in/° F. and having an outer surface having a refractory coating thereon exposed to said molten aluminum and resistant to attack by said molten aluminum, said refractory coating selected from the group consisting of one of $Al_2O_3$, $ZrO_2$, $Y_2O_3$ stabilized $ZrO_2$, and $Al_2O_3$—$TiO_2$ having a coefficient of thermal expansion less than $5\times10^{-6}$ in/in/° F.

* * * * *